US005188178A

United States Patent [19]

Noyes

[11] Patent Number: 5,188,178

[45] Date of Patent: Feb. 23, 1993

[54] METHOD AND APPARATUS FOR AUTOMATIC WELL STIMULATION

[75] Inventor: Jonathan C. Noyes, Pleasanton, Tex.

[73] Assignee: Texaco Inc., White Plains, N.Y.

[21] Appl. No.: 738,755

[22] Filed: Aug. 1, 1991

[51] Int. Cl.[5] ..... E21B 43/00

[52] U.S. Cl. ..... 166/310; 166/75.1

[58] Field of Search ..... 166/310, 67, 69, 72, 166/75.1, 77, 97, 97.5

[56] References Cited

U.S. PATENT DOCUMENTS

| | | | |
|---|---|---|---|
| 3,765,489 | 10/1973 | Maly | 166/310 |
| 4,326,585 | 4/1982 | McStravick | 166/310 X |
| 4,785,880 | 11/1988 | Ashton | 166/75.1 X |
| 5,016,708 | 5/1991 | Baer et al. | 166/75.1 |

*Primary Examiner*—Thuy M. Bui

*Attorney, Agent, or Firm*—Jack H. Park; Kenneth R. Priem; Russell J. Egan

[57] ABSTRACT

An apparatus for stimulating production from oil and gas wells has a magazine which is sequentially actuated to allow chemical stimulant to be dispensed into the well to cause agitation of fluid loading up said well and allow the recovery of hydrocarbons therefrom.

12 Claims, 2 Drawing Sheets

METHOD AND APPARATUS FOR AUTOMATIC WELL STIMULATION

BACKGROUND OF THE INVENTION

1. The Field of the Invention

The present invention is a method and apparatus to stimulate production of oil and gas from producing wells by periodically dispensing a stimulant downhole into the well.

2. The Prior Art

In the production of oil and gas in some fields, there is a tendency for the wells to "load/up" meaning that a fluid, such as water, settles on top of the gases that cause the hydrocarbon fluids to rise to the wellhead. This problem can sometimes be solved by dropping into the well an appropriate stimulant which will cause agitation of the fluid and allow the gas and oil to rise to the wellhead. There are many known stimulants, which will effect the desired stimulation by agitating the overlying fluid to allow the gas and oil to rise therethrough. Examples of these are the Wilscote Flo-Sticks TM produced by Wilson Industries of Houston, Tex. and which contain an unloader/foamer alone or in combination with condensate handling materials acid treatment descaler and corrosion inhibitor. Another example is the amine salt, more commonly referred to as a brine foamer, produced by Anderson Price Industries of Victoria, Tex. under the tradename Gulf Coast Sticks. Yet another example is the surfactant compound/amine salt stick produced by Fisher-Stevens Inc. of Victoria, Tex.

Previously the injection of a stimulant into a well was accomplished by an individual visiting the well site and physically dropping the stimulant downhole. While this manual method is effective, it does have the major drawback of limiting or inhibiting production in that there might be a considerable time lapse between the time when the well "loads up" and the next scheduled visit of the Lease Operator to that well. This also would apply to situations, for example, in offshore or other extremely difficult locations to visit which visits might be hampered due to certain localized weather conditions, such as storms offshore or flooding inland.

It is therefore an object of the present invention to provide an automatic well stimulating method and apparatus which will periodically cause a stimulant to be dropped downhole to agitate fluid loading up the well and allow the recovery of gas and oil from that well. The subject invention could also be used in conjunction with condition response actuation and/or with remote control actuation after flow measurement.

SUMMARY OF THE INVENTION

The subject automatic well stimulator includes a housing to be mounted above a wellhead by means of a known check valve. The subject stimulator has a housing enclosing a motor driven magazine which is sequenced over the wellbore, thereby allowing a stick of stimulant to drop through the check valve into the wellbore. The subject invention is driven by an electric motor powered by a battery and preferably the battery is connected to a solar recharging system thereby making the entire unit substantially self-contained and independent. The motor is preferably controlled by a timer to cause stimulation in accordance with the known history of the well. However, other means, such as pressure sensing devices or flow measuring devices can be used to actuate the subject invention to cause dispensing of a stimulant into the well. Also, it could be arranged to actuate in response to remote control, such as by electronic signaling.

BRIEF DESCRIPTION OF THE DRAWINGS

The present invention will now be described by way of example with reference to the accompanying drawings in which.

DETAILED DESCRIPTION OF THE PREFERRED EMBODIMENT

Figure 1:
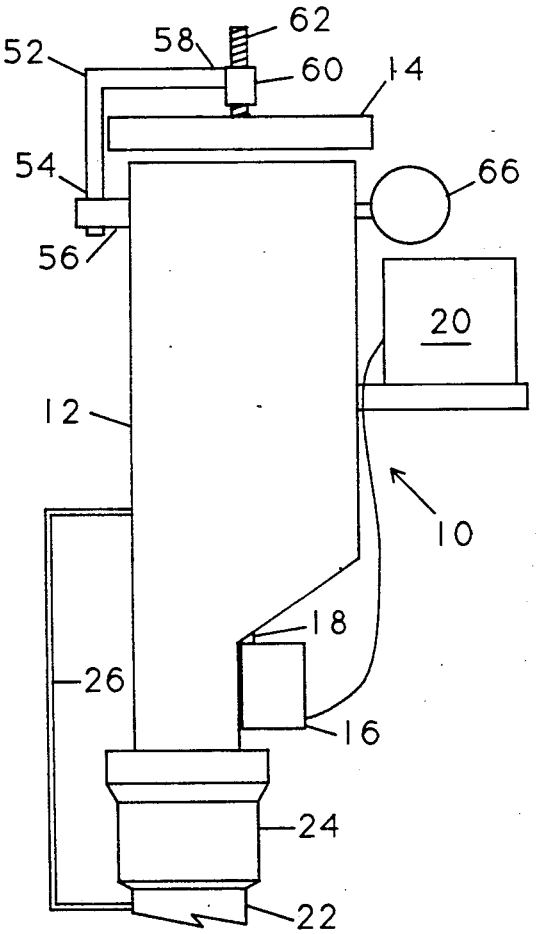
FIG. 1 is a side elevation of the subject invention.

The subject well stimulator 10 includes a substantially cylindrical housing 12 closed by a cover 14. An electric motor 16 is mounted externally on the housing with its drive shaft 18 axially aligned with and extending into housing 12. This motor 16 is powered by a power supply 20, which preferably is a solar recharged battery pack.

The housing 12 is mounted on top of a wellhead 22 through a check valve 24. The check valve 24 is not of the pressure sealing type but is a one way valve intended to prevent any surges of fluid from the wellbore from entering into the housing and causing premature activation of the stimulant sticks. An equalizer line 26 passes around the check valve 24 connecting wellhead 22 to housing 12.

Figure 2:
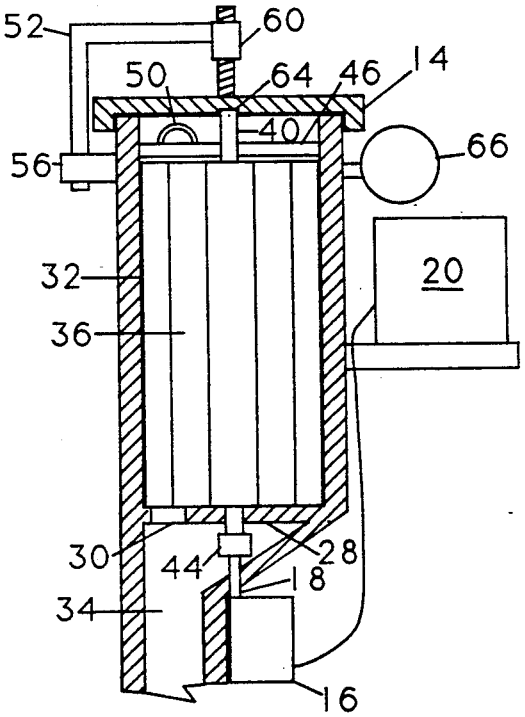
FIG. 2 is a vertical section through the embodiment of the invention of FIG. 1.
Figure 3:
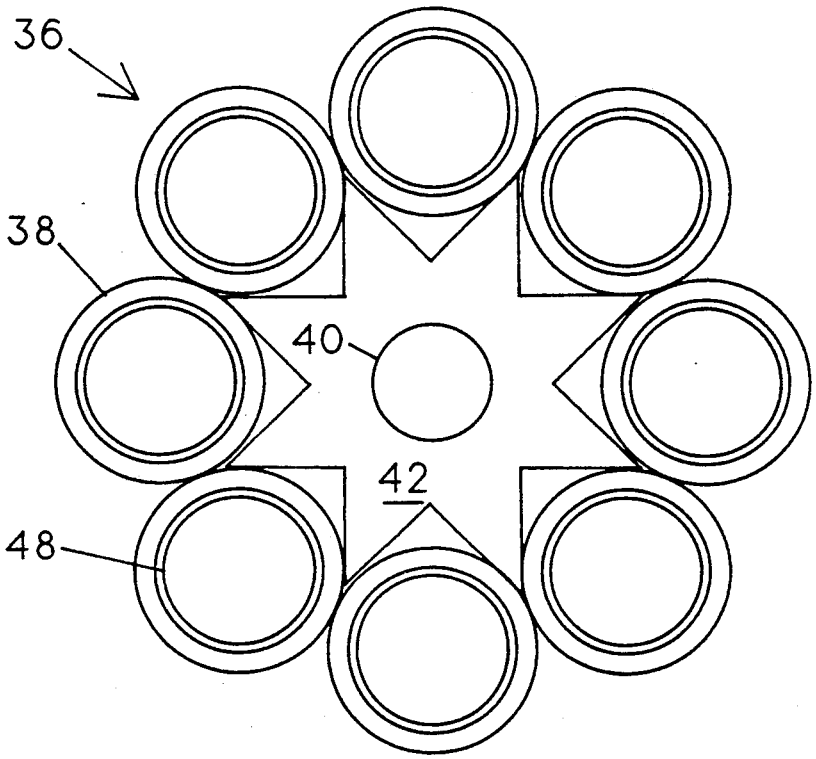
FIG. 3 is a plan view of the magazine portion of the present invention.
Figure 4:
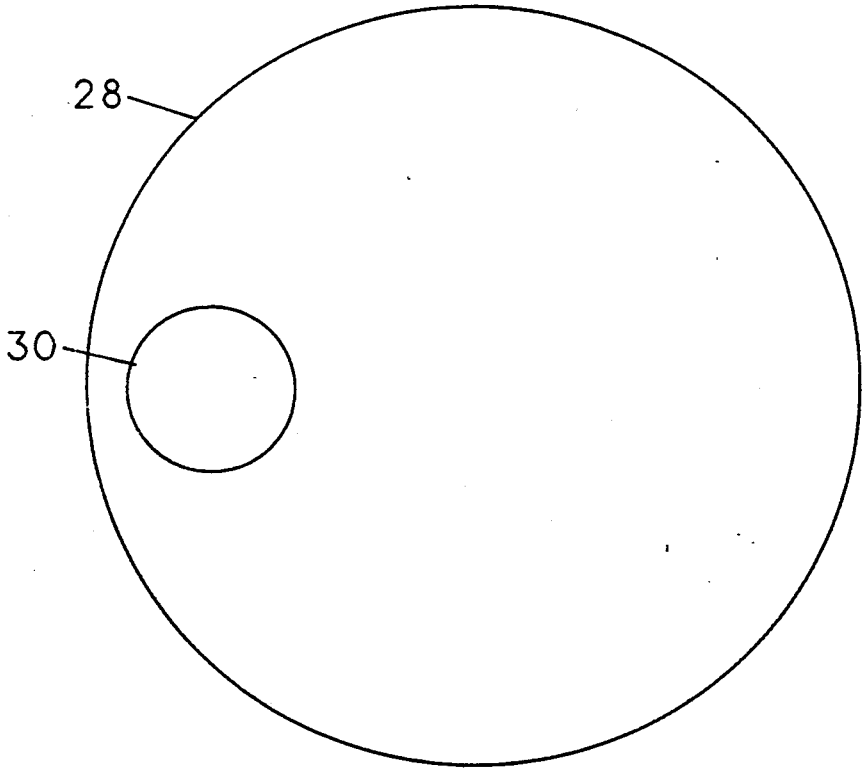
FIG. 4 is a plan view of the plate of the invention.

Turning now to FIG. 2, the housing 12 contains a plate 28 extending substantially transversely of the axis of the housing, which axis is parallel to and offset from the axis of the wellbore. The plate 28 contains an aperture 30 which is directly aligned above the wellbore. The plate 28 divides the housing into an upper chamber 32 and lower chamber 34. The upper chamber includes a stimulant magazine 36 which has here been depicted as a carousel having eight cylinders 38 attached to and rotatively driven by axle 40 by at least one spiderweb plate 42 (see FIG. 3). The axle 40 is in turn is connected by coupling means 44 to be driven by shaft 18 of the motor 16 which is powered by the previously mentioned solar recharged battery pack 20. An internal plate or cover 46 is provided to protect the stimulant rods 48 in the carousel cylinders 36 from water which would cause their untimely actuation in the housing rather than downhole. The cover 46 is provided with a handle 50 to help its insertion and removal as it fits closely within chamber 32.

The subject invention is provided with a means for removing the heavy cover 18 from the housing 12. An angled arm 52 has a first end 54 mounted in a bearing 56 fixed to the housing 12. The other end 58 of the arm 52 has an internally threaded sleeve 58 which receives therein a threaded shaft 60 fixed extending normally from the axis of the cover 14. Rotation of the cover 14 with respect to the housing 12 causes the shaft 62 to raise the cover and arm 52 allows it to be swung away providing access to the top of the housing. The cover 14 is also provided with an inner axial recess 64 which receives the upper end of axle 40 to stabilize the carousel 3 during rotation.

In operation the magazine 36 loaded with a number of the previously described known stimulant rods 48, which rods can all be alike or can be varied to charge the well with a particular sequence of stimulants. Each rod is 1½ to 2 inches in diameter and 12 to 18 inches in length and is generally color coded to denote its contents. The magazine 36 is rotationally sequenced to move each cylinder 38 above the aperture 30 to allow the stimulant rod 48 to drop therethrough into the well.

The subject invention preferably actuated by a timer system (not shown) although it is possible to control the subject apparatus with alternate means, such as pressure sensing means 66 or even means responsive to the output of the well, for example, a gas or oil sensing or flow measuring apparatus (also not shown).

The present invention may be subject to many modifications and changes without departing from the spirit or essential characteristics thereof. The present embodiment is therefore to be considered in all respects as illustrative and not restrictive of the scope of the invention.

I claim:

1. An apparatus for stimulating production from a hydrocarbon producing well comprising:

a housing adapted to be mounted above a well and connected thereto through a check value, said housing defining a chamber;

a magazine mounted in said chamber and accommodating a plurality of well stimulant sticks;

means to sequentially advance said magazine to allow individual sticks of stimulant to be dispensed into said well causing the stimulation of the contents thereof for increased productivity.

2. The apparatus according to claim 1 wherein said apparatus further comprises:

motor means connected to sequentially advance said magazine.

3. The device according to claim 2 further comprising:

timer means connected to control said motor for periodically advancing said magazine.

4. The apparatus according to claim 3 further comprising:

battery means for powering said motor.

5. The apparatus according to claim 4 further comprising:

solar means for recharging said battery.

6. The apparatus according to claim 1 further comprising;

means to protect said sticks of stimulant from being activated while in said chamber.

7. The apparatus according to claim 1 further comprising cover means closing said housing; and means to remove solid cover means.

8. A method for stimulating production from hydrogen producing well comprising the steps of:

providing said well with an apparatus having a magazine adapted to receive a supply of sticks of stimulating chemical which will cause dispersion of fluid loading up said well and allow the egress of hydrocarbons from said well; and periodically actuating said magazine to dispense one of said stimulant stocks into said well whereby production from the well is restored.

9. A method according to claim 8 wherein said stimulant is dispensed in response to a timer.

10. A method according to claim 8 wherein said stimulant is dispensed in response to a sensed well condition.

11. A method according to claim 10 wherein said sensed well condition is pressure.

12. A method according to claim 10 wherein said sensed well condition is production flow.

* * * * *